US005595629A

United States Patent [19]

Begala

[11] Patent Number: 5,595,629

[45] Date of Patent: Jan. 21, 1997

[54] PAPERMAKING PROCESS

[75] Inventor: Arthur J. Begala, Naperville, Ill.

[73] Assignee: Nalco Chemical Company, Naperville, Ill.

[21] Appl. No.: 532,911

[22] Filed: Sep. 22, 1995

[51] Int. Cl.[6] ..... D21H 21/06

[52] U.S. Cl. ..... 162/158; 162/164.5; 162/168.2; 162/168.3; 162/183

[58] Field of Search ..... 162/168.2, 168.3, 162/164.5, 183, 158

[56] References Cited

U.S. PATENT DOCUMENTS

| | | | |
|---|---|---|---|
| 4,070,236 | 1/1978 | Carrard et al. | 162/164.5 |
| 4,388,150 | 6/1983 | Sunden et al. | 162/175 |
| 4,753,710 | 6/1988 | Langley et al. | 162/168.3 |
| 4,913,775 | 4/1990 | Langley et al. | 162/168.3 |
| 5,098,520 | 3/1992 | Begala | 162/168.3 |
| 5,338,406 | 8/1994 | Smith | 162/168.3 |
| 5,368,694 | 11/1994 | Rohlf et al. | 162/164.5 |

*Primary Examiner*—Peter Chin
*Attorney, Agent, or Firm*—James J. Drake; Robert A. Miller; Patricia A. Charlier

[57] ABSTRACT

A papermaking process comprising forming an aqueous cellulosic papermaking slurry and adding a cationic polymer and an anionic polymer to the slurry to increase retention and/or drainage is disclosed. The anionic polymer comprises a formaldehyde condensate of a naphthalene sulfonic acid salt (NSF) with a molecular weight range of 500 to 120,000, while the cationic polymer has a molecular weight range of from 500,000 to 20 million. After addition of the polymers, the slurry is drained to form a sheet, and the sheet is dried.

11 Claims, No Drawings

PAPERMAKING PROCESS

BACKGROUND OF THE INVENTION

1. Field of the Invention

The present invention is in the technical field of papermaking, and more particularly in the technical field of wet-end additives to papermaking furnish.

2. Description of the Prior Art

In the manufacture of paper an aqueous cellulosic suspension or slurry is formed into a paper sheet. The cellulosic slurry is generally diluted to a consistency (percent dry weight of solids in the slurry) of less than 1 percent, and often below 0.5 percent ahead of the paper machine, while the finished sheet must have less than 6 weight percent water. Hence, the dewatering aspects of papermaking are extremely important to the efficiency and cost of the manufacture.

The least costly dewatering method is drainage, and thereafter more expensive methods are used, for instance vacuum pressing, felt blanket blotting and pressing, evaporation and the like, and any combination of such methods. Since drainage is both the first dewatering method employed and the least expensive, improvement in the efficiency of drainage will decrease the amount of water required to be removed by other methods and improve the overall efficiency of dewatering and reduce the cost thereof.

Another aspect of papermaking that is extremely important to the efficiency and cost of manufacture is retention of furnish components on and within the fiber mat being formed during papermaking. A papermaking furnish contains particles that range in size from about the 2 to 3 millimeter size of cellulosic fibers to fillers measuring only a few microns. Within this range are cellulosic fines, mineral fillers (employed to increase opacity, brightness and other paper characteristics) and other small particles that generally, without the inclusion of one or more retention aids, would pass through the spaces (pores) between the cellulosic fibers in the fiber mat being formed.

One method of improving the retention of cellulosic fines, mineral fillers and other furnish components on the fiber mat is the use of a coagulant/flocculant system, added ahead of the paper machine. In such a system there is first added to the furnish a coagulant, for instance a low molecular weight cationic synthetic polymer or a cationic starch, which coagulant generally reduces the negative surface charges present on the particles in the furnish, particularly cellulosic fines and mineral fillers, and thereby agglomerates such particles. The coagulant is followed by the addition of a flocculant. The flocculant is generally a high molecular weight anionic synthetic polymer which bridges the particles and/or agglomerates, from one surface to another, binding the particles into large agglomerates. The presence of such large agglomerates in the furnish increases retention The agglomerates are filtered out of the water onto the fiber web, where unagglomerated particles otherwise would to a great extent pass.

While a flocculated agglomerate generally does not interfere with the drainage of the fiber mat to the extent that would occur if the furnish were gelled or contained an amount of gelatinous material, when such flocs are filtered by the fiber web the pores thereof are reduced, thus reducing drainage efficiency. Hence, the retention is increased at the expense of decreasing drainage.

Another system employed to provide an improved combination of retention and dewatering is described in U.S. Pat. Nos. 4,753,710 and 4,913,775, inventors Langley et al., issued respectively Jun. 28, 1988 and Apr. 3, 1990, the disclosures of which are incorporated hereinto by reference. In brief, such method adds to the aqueous cellulosic papermaking suspension first a high molecular weight linear cationic polymer before shearing the suspension, followed by the addition of bentonite after shearing. The shearing generally is provided by one or more of the cleaning, mixing and pumping stages of the papermaking process, and the shearing breaks down the large flocs formed by the high molecular weight polymer into microflocs, and further agglomeration then ensues with the addition of the bentonite clay particles.

Another system uses the combination of cationic starch followed by colloidal silica to increase the amount of material retained on the web by charge neutralization and adsorption of smaller agglomerates. This system is described in U.S. Pat. No. 4,388,150, inventors Sunden et all, issued Jun. 14, 1983.

Dewatering generally, and particularly dewatering by drainage, is improved when the pores of the paper web are less plugged, and it is believed that retention by adsorption in comparison to retention by filtration reduces pore plugging.

Greater retention of fines and fillers permits a reduction in the cellulosic fiber content of the paper being formed. As pulps of less quality are employed to reduce papermaking costs, the retention aspect of papermaking becomes more important because the fines content of such lower quality pulps is generally greater than that of pulps of higher quality.

Greater retention of fines, fillers and other slurry components reduces the amount of such substances lost to the white water and hence reduces the amount of material waste, the cost of waste disposal and the adverse environmental effects therefrom.

Another important characteristic of a given papermaking process is the formation of the paper sheet produced. Formation is determined by the variance in light transmission within a paper sheet, and a high variance is indicative of poor formation. As retention increases to a high level, for instance a retention level of 80 or 90 percent, the formation parameter generally abruptly declines from good formation to poor formation. It is believed that as the retention mechanisms of a given papermaking process shift from filtration to adsorption, the deleterious effect on formation, as high retention levels are achieved, will diminish, and a good combination of high retention with good formation is attributed to the use ofbentonite in U.S. Pat. No. 4,913,775.

It is generally desirable to reduce the amount of material employed in a papermaking process for a given purpose, without diminishing the result sought. Such add-on reductions may realize both a material cost savings and handling and processing benefits.

It is also desirable to use additives that can be delivered to the paper machine without undue problems. An additive that is difficult to dissolve, slurry or otherwise disperse in the aqueous medium may require expensive equipment to feed it to the paper machine. When difficulties in delivery to the paper machine are encountered, the additive is often maintained in aqueous slurry form by virtue of high energy input equipment. In contrast, additives that are easily dissolved or dispersed in water require less energy and expense and their uniformity of feed is more reliable.

The treatment of an aqueous cellulosic slurry with a cationic polymer followed by shear, preferably a high degree of shear, is a wet-end treatment in itself known in the field, for instance as described in U.S. Pat. Nos. 4,753,710 and 4,913,775, inventors Langley et al., issued respectively Jun. 28, 1988, and Apr. 3, 1990, the disclosures of which are incorporated herein by reference. The present invention departs from the disclosures of these patents in the use of a low molecular weight anionic polymer after the shear, instead of bentonite. Also, it has been found in this case that equivalent or greater activity can be found by reversing the order of addition of the compounds, i.e., introducing the anionic polymer prior to the cationic polymer.

As described in the Langley patents, paper or paper board is generally made from a suspension or slurry of cellulosic material in an aqueous medium, which slurry is subjected to one or more shear stages, which stages generally are a cleaning stage, a mixing stage and a pumping stage, and thereafter the suspension is drained to form a sheet, which sheet is then dried to the desired, and generally low, water concentration. As disclosed in these patents, the cationic polymer generally has a molecular weight of at least 500,000, and preferably the molecular weight is above 1,000,000 and may be above 5,000,000, for instance in the range of from 10 to 30 million or higher. The cationic polymer is substantially linear; it may be wholly linear or it can be slightly cross linked provided its structure is still substantially linear in comparison with the globular structure of cationic starch. Preferably the cationic polymer has a relatively high charge density of for instance about 0.2 and preferably at least about 0.35, and most preferably about 0.4 to 2.5 or higher, equivalents of cationic nitrogen per kilogram of polymer. When the polymer is formed by polymerization of cationic, ethylenically unsaturated monomer, optionally with other monomers, the amount of cationic monomer will normally be above 2 mole percent and usually above 5 mole percent, and preferably above 10 mole percent, based on the total moles of monomer used in forming the polymer. The amount of the cationic polymer employed in the process, in the absence of any substantial amount of cationic binder, is typically at least 0.005 percent based on dry weight of the slurry, and preferably 0.6 percent in the substantial absence of cationic binder and 0.5 percent in the presence of cationic binder, same basis, which is from 1.1 to 10 times, and usually 3 to 6 times, the amount of cationic polymer that would be used in conventional (dual polymer) processes, and hence is considered "an excess amount" of cationic polymer. The cationic polymer is preferably added to thin stock, preferably cellulosic slurry having a consistency of 2 percent or less, and at most 3 percent. The cationic polymer may be added to prediluted slurry, or may be added to a slurry together with the dilution water.

Also as described in aforesaid patents, the use of the excess amount of synthetic cationic polymeric flocculant is believed necessary to ensure that the subsequent shearing results in the formation of microflocs which contain or carry sufficient cationic polymer to render at least parts of their surfaces cationically charged, although it is not necessary to render the whole slurry cationic. Thus the Zeta potential of the slurry, after the addition of the cationic polymer and after the shear stage, may be cationic or anionic.

The present invention shows that low molecular weight cationic polymers may be used in conjunction with the anionic polymer of U.S. Pat. No. 5,098,520, the disclosure of which is incorporated herein by reference. In U.S. Pat. No. 5,098,520 the cationic polymer is limited to a molecular weight of 1,000,000 and higher.

SUMMARY OF THE INVENTION

A papermaking process comprising forming an aqueous cellulosic papermaking slurry and adding a cationic polymer and an anionic polymer to the slurry to increase retention and/or drainage is disclosed. The anionic polymer comprises a formaldehyde condensate of a naphthalene sulfonic acid salt (NSF) with a molecular weight range of 500 to 120,000, while the cationic polymer has a molecular weight range of from 500,000 to 20 million. After addition of the polymers, the slurry is drained to form a sheet, and the sheet is dried.

DESCRIPTION OF THE PREFERRED EMBODIMENTS

A papermaking process comprising forming an aqueous cellulosic papermaking slurry and adding a cationic polymer and an anionic polymer to the slurry to increase retention and/or drainage is disclosed. The anionic polymer comprises a formaldehyde condensate of a naphthalene sulfonic acid salt with a molecular weight range of 500 to 120,000, while the cationic polymer has a molecular weight range of from 500,000 to 20 million. Specifically, the naphthalene sulfonic acid salt may be formed from any alkaline earth or alkali metal salt or ammonia. After addition of the polymers, the slurry is drained to form a sheet, and the sheet is dried.

Other additives may be charged to the cellulosic slurry without any substantial interference with the activity of the cationic polymer/anionic polymer combination of the present invention. Such other additives include for instance sizing agents, such as alum and rosin, pitch control agents, cationic starch, extenders such as ansilex, biocides and the like. As mentioned elsewhere herein, however, in the preferred embodiment the cellulosic slurry should be, at the time of the addition of the cationic polymer, anionic or at least partially anionic, and hence the choice of other additives preferably should be made with such anionic nature of the slurry as a limiting factor. Indeed, it is often the case, the cationic coagulants are added to control the amount of anionic character of the slurry. Such cationic coagulants could include alum, polyaluminum chloride, polyamine epichlorohydrin polymers, polyethylene imines, polyamino amide epichlorohydrin polymers, polydiallyldimethylammonium chloride and glyoxylated acrylamide/diallyldimethylammonium chloride co-polymers. Indeed it is even desirable to add one of these coagulants prior to the addition of the anionic NSF and before the high molecular cationic polymer.

THE ANIONIC POLYMER

The anionic polymer which is added to the cellulosic slurry prior to or after treatment with the high molecular weight cationic polymer is a low to medium molecular weight naphthalene sulfonate formaldehyde condensed polymer. Such polymer has a weight average molecular weight of from 500 to 120,000. Due to the chemistry involved in the formaldehyde condensation process, the typical polymer preparation will consist of a number of molecular weight species and the weight average will reflect in which direction the distribution of species is skewed. In no case will there be only a single molecular weight entity and it is recognized that the distribution and resulting average molecular weight will be important in determinitig the efficiency of the product as a retention and drainage enhancer. In terms of intrinsic viscosity, IV, the anionic polymer generally is within the range 0.02 to 0.05, and in instances, may be as high as 0.30.

The anionic groups are provided by naphthalene sulfonate moieties and control the anionic charge density of the polymer. This charge density can be modified by adding another condensable species, phenol, hrea or reelamine, which will co-polymerize with the naphthalene sulfonate and formaldehyde. In this way the charge per unit weight can be decreased by adding a neutral or cationic species to the cross-lined, anionic sulfonate.

The charge on the anionic polymer is preferably 2.0 to 3.0 equivalents per kilogram but may be as low as 1.0 or as high as 4.0 equivalents per kilogram.

THE CATIONIC POLYMER

The cationic polymer which is added to the cellulosic slurry prior to or after treatment with the anionic polymer is a high molecular weight cationic polymer. Under the preferred embodiment of the application, these cationic polymers include dimethylaminoethyl acrylate methyl chloride quat (DMAEA.MCQ), dimethylaminoethylmethacrylate (DMAEM), dimethylaminoethyl acrylate benzyl chloride quat (DMAEA.BCQ), dimethylaminoethylmethacrylate methyl chloride quat (DMAEM.MCQ), [3-methacryloylamino-propyl]trimethyl ammonium chloride (MAPTAC), and N-[3-(Dimethylamino)propyl]-methacrylamide (DMAPMA). In yet another embodiment of the invention, the cationic polymers comprise copolymers of the polymers listed above copolymerized with acrylamide.

Preferably, the copolymers would be added in an amount of from about 10 to about 80 mole percent. Most preferably, the DMAEA.BCQ/Acrylamide copolymer would be added in an amount of about 30 mole percent. Most preferably, the DMAEA.MCQ/Acrylamide copolymer would be added in an amount of about 10 mole percent.

BRITT JAR TEST

The Britt Jar Test employed in Examples 1 to 5 used a Britt CF Dynamic Drainage Jar developed by K. W. Britt of New York University, which generally consists of an upper chamber of about 1 liter capacity and a bottom drainage chamber, the chambers being separated by a support screen and a drainage screen. Below the drainage chamber is a downward extending flexible tube equipped with a clamp for closure. The upper chamber is provided with a variable speed, high torque motor equipped with a 2-inch 3-bladed propeller to create controlled shear conditions in the upper chamber. The test was stock to the following sequence:

| Time | Action |
|---|---|
| 0 seconds | Commence shear stirring at 750 rpm-Add cationic starch |
| 10 seconds | Add the cationic polymer 2000 rpm |
| 40 seconds | Reduce the shear to 750 rpm |
| 50 seconds | Add the anionic polymer (or silica) |
| 60 seconds | Open the tube clamp to commence drainage |
| 90 seconds | Stop draining |

The material so drained from the Britt Jar (the "filtrate") is collected and diluted with water to provide a turbidity which can be measured conveniently. The turbidity of such diluted flitrate, measured in Nephelometric Turbidity Units or NTU's, is then determined. The turbidity of such a flitrate is inversely proportional to the papermaking retention performance; the lower the turbidity value, the higher is the retention of filler and/or fines. The turbidity values were determined using a Hach Turbidimeter. In one case, instead of measuring turbidity, the % Transmittance (T) of the sample was determined using a DigiDisc Photometer. The transmittance is directly proportional to papermaking retention performance; the higher the transmittance value, the higher is the retention value.

DRAINAGE TEST

Drainage was determined using a unique apparatus, termed an Alchem Tester, developed to evaluate the drainage of paper machine stocks. This tester consists of a 4-part plexiglass chamber which includes a stock reservoir, baffled drainage tube, and two-piece bottom drainage chamber. The two sections are screwed or clamped together with a support screen and drainage screen sandwiched between two gaskets. The test provides a gravity "free" (i.e. no vacuum is used) drainage value which is determined at machine consistency rather than diluting and determining a Canadian Standard Freeness. A 500 ml thin stock sample is poured into the reservoir, the stopper plug is released and the volume drained in 5 seconds is collected. It is normal procedure to use the Britt Jar for mixing the furnish and polymers using the same sequence and shear rates as are employed for retention studies.

THE TEST FURNISH

Two types of laboratory prepared furnishes were used during this work. One was alkaline at pH 7.8 and the other was acid at pH 5.0. The alkaline cellulosic stock or slurry used in Examples x to y was comprised of 70 weight percent fiber and 30 weight percent filler, diluted to an overall consistency of 0.5 percent with formulation water. The fiber was a 60/40 blend by weight of bleached hardwood kraft and bleached softwood kraft, separately beaten to a Canadian Standard Freeness value range of from 340–380 C.F.S. The filler was a commercial calcium carbonate provided in dry form. The formulation water contained 200 ppm calcium hardness (added as $CaCl_2$), 152 ppm magnesium hardness (added as $MgSO_4$) and 110 ppm bicarbonate alkalinity (added as $NaHCO_3$).

The acid furnish had the same fiber ratio but was comprised of 92.5 weight percent fiber and 7.5 weight percent filler. The filler was a combination of 2.5 percent titanium dioxide and 5.0 percent kaolin clay. Other additives were 0.5 weight percent rosin size and 0.9 weight percent alum based on dry furnish solids. The pH was adjusted with sulfuric acid. The total amount of either furnish used was 0.5 liters which was equivalent to 2.5 grams of fiber plus filler.

EXAMPLES 1 to 4

Using one of the test stocks described above, the Britt Jar and Alchem Drainage Tests were employed to determine retention and drainage performance of Compounds A through I which are listed in Table 1 below. These retention/drainage enhancers were compared to the addition of a cationic flocculant and cationic starch added without benefit of the enhancing compound. The cationic flocculant employed in each case was an acrylamide/dimethylaminoethylacrylate methyl chloride quaternary ammonium salt copolymer having 10 mole percent of the cationic mer unit, and having an Intrinsic Viscosity (IV) of 17.5 dl/g. The polymeric cationic flocculant was charged to the test stock in the amount of 0.075 parts by Weight per hundred parts by weight of dry stock solids (1.5 lb/ton dry weight of slurry solids). Cationic starch is commonly used in fine paper furnishes and was added at 0.50 parts by weight per hundred parts by weight of dry stock solids (10.0 lbs/ton dry weight of slurry solids). The starch used in this instance was a cationic potato starch, Solvitose N, which was introduced to the furnish at the start of the Britt Jar sequence.

TABLE 1

| IDENTITY OF COMPOUNDS TESTED AS RETENTION AND DRAINAGE ENHANCERS | |
|---|---|
| Compound A | Small particle size colloidal silica - nominal 4 nm diameter |
| Compound B | Naphthalene sulfonate formaldehyde condensate (calcium salt) Weight average molecular weight = 6400 |
| Compound C | Naphthalene sulfonate formaldehyde condensate (calcium salt) |
| Compound D | Naphthalene sulfonate formaldehyde condensate (sodium salt) Weight average molecular weight = 4700 |
| Compound E | Naphthalene sulfonate formaldehyde condensate (sodium salt) |
| Compound F | Polycarboxylic acid (sodium salt) Intrinsic viscosity = 1.2 dl/g |
| Compound G | Naphthalene-1,5-disulfonate (sodium salt) |
| Compound H | Naphthalene-2-sulfonate (sodium salt) |
| Compound I | A commercial ligno-sulfonate |

The following examples are presented to describe preferred embodiments and utilities of the invention and are not meant to limit the invention unless otherwise stated in the claims appended hereto.

EXAMPLE 1

Various low molecular weight anionic polymeric compounds were compared vs. colloidal silica, a widely used commercial retention additive, in a standard alkaline laboratory furnish. Drainage, as well as retention data, was collected employing the Britt Dynamic Drainage Jar and Alchem Tester as described above. The same addition and shear sequence used for the retention study was implemented before pouring the resulting treated slurry through the Alchem drainage tester. The data found for these retention and drainage studies is shown in Table 2. In this study the initial turbidity of the Britt Jar filtrate diluted one to three was 400 NTU and the volume collected from the Alchem Tester was 175 ml with all the components added except the anionic compound.

TABLE 2

| Relative Product Dosage to Achieve the Indicated Improvements | | | | | | | | | |
|---|---|---|---|---|---|---|---|---|---|
| Anionic | Charge | Reduction in Filtrate Turbidity % | | | | Increase in Drainage Volume % | | | |
| Enhancer | meq./gram | 20 | 30 | 40 | 50 | 20 | 30 | 40 | 50 |
| Compound A | 0.51 | 1.00 | 1.00 | 1.00 | 1.00 | 1.00 | 1.00 | 1.00 | 1.00 |
| Compound F | 13.9 | 0.39 | 0.48 | 0.57 | NA | 0.32 | 0.37 | 0.39 | 0.55 |
| Compound I | 1.44 | 0.68 | 1.06 | 1.25 | 1.34 | 0.81 | 0.82 | 0.81 | 0.91 |
| Compound B | 2.94 | 0.27 | 0.30 | 0.33 | 0.41 | 0.25 | 0.28 | 0.29 | 0.28 |
| Compound D | 1.96 | 0.97 | 1.57 | NA | NA | 2.57 | NA | NA | NA |

These data are expressed in terms of the amount of the test compound required to obtain the desired performance level relative to Compound A, colloidal silica. In nearly every case there is no problem in obtaining improvements of 50% in both retention and drainage. The differences between the compounds tested arises in the amount of polymer which is required, i.e. its efficiency, vs. Compound A. Of the two naphthalene sulfonate condensates examined, Compound B, which has a higher molecular weight and charge, is more efficient than Compound D and is also more efficient than any of the other compounds examined.

EXAMPLE 2

Additional testing was done using the alkaline furnish and comparing several different naphthalene sulfonate formaldehyde condensates to colloidal silica. The data given in Table 3, for both retention and drainage, show improvements over the initial turbidity (diluted one to three) of 367 NTU and drainage rate of 167 ml. obtained when all components except the anionic compound were added to the furnish.

TABLE 3

| COM- | Dilute Filtrate Turbidity (NTU) | | | DDJ FILTRATE TURBIDITY IMPROVEMENT % | |
|---|---|---|---|---|---|
| POUND | 0.0 lb/t | 0.5 lb/t | 1.0 lb/t | 0.5 lb/ton | 1.0 lb/ton |
| BLANK | 367 | | | | |
| A | | 275 | 187 | 25.1 | 49.0 |
| B | | 170 | 120 | 53.7 | 67.3 |
| C | | 225 | 195 | 38.7 | 46.9 |
| D | | 195 | 195 | 46.9 | 46.9 |
| E | | 200 | 200 | 45.5 | 45.5 |
| | Volume Collected | | (ml) | DRAINAGE IMPROVEMENT | |
| BLANK | 167 | | | | |
| A | | 176 | 200 | 5.4 | 19.5 |
| B | | 206 | 233 | 23.4 | 39.6 |
| C | | 201 | 214 | 20.4 | 28.0 |
| D | | 171 | 185 | 2.3 | 10.8 |
| E | | 174 | 191 | 3.9 | 14.4 |

Again the naphthalene sulfonate condensates show increased efficiency vs. the colloidal silica at lower dosages especially Compounds B and C.

EXAMPLE 3

This study used an acid furnish at pH 5.0 and components described above. Table 4 shows improvements in retention (initial turbidity of Britt Jar filtrate diluted one to three was 392 with all components added except the anionic compound).

TABLE 4

| COM- | Turbidity/3 (NTU) | | | DDJ FILTRATE TURBIDITY IMPROVEMENT % | |
|---|---|---|---|---|---|
| POUND | 0.0 lb/t | 0.5 lb/t | 1.0 lb/t | 0.5 lb/ton | 1.0 lb/ton |
| BLANK | 392 | | | | |
| A | | 318 | 315 | 18.9 | 19.6 |
| B | | 245 | 193 | 37.5 | 50.8 |
| C | | 290 | 300 | 26.0 | 23.5 |
| D | | 270 | 245 | 31.1 | 37.5 |
| E | | 340 | 325 | 13.3 | 17.1 |
| F | | 345 | 355 | 12.0 | 9.4 |

Under acid conditions it should be noted that the naphthalene sulfonate condensates are particulrly effective vs. colloidal silica, Compound A, nd the polycarboxylic acid, Compound F.

EXAMPLE 4

In a separate experiment under acid conditions (pH 5.0) the condensed naphthalene sulfonates were compared to monomeric sulfonates, compounds G and H, which showed negative improvement in the retention studies compared to the polymeric sulfonates and colloidal silica. These data are shown in Table 5. When all components except the anionic compound was added the turbidity of the Britt Jar filtrate diluted one to three was 366 NTU. It is evident in this case that the monomeric species had a detrimental effect on retention and this effect increased with increasing dosage. On the other hand the polymeric condensed sulfonates showed positive effects and these effects were predominately more positive than those shown by colloidal silica.

TABLE 5

| COM- | BJ Filtrate/3 (NTU) | | | DDJ FILTRATE TURBIDITY IMPROVEMENT % | |
|---|---|---|---|---|---|
| POUND | 0.0 lb/t | 0.5 lb/t | 1.0 lb/t | 0.5 lb/ton | 1.0 lb/ton |
| BLANK | 366 | | | | |
| A | | 335 | 295 | 8.5 | 19.5 |
| B | | 270 | 260 | 26.2 | 29.0 |
| D | | 275 | 325 | 24.9 | 11.2 |
| G | | 375 | 400 | −2.3 | −9.2 |
| H | | 375 | 380 | −2.3 | −3.7 |

EXAMPLE 5

Samples of mill furnish (containing 98.5 weight fiber and 1.5 weight percent titanium dioxide at a solids level of 0.34 weight percent) from an acid fine paper machine running at pH 3.9 and using 18 lbs/ton papermakers alum and 4 lbs/ton cationic starch (on a furnish solids basis) were used to test a naphthalene sulfonate formaldehyde condensate in conjunction with a high molecular weifght, 10 mole % cationic polyacrylamide described previously. In this case the anionic polymer was added either after or before the cationic polymer during a Britt Jar test. The data for these experiments was collected as transmittance of the Britt Jar filtrate diluted ⅓ and is shown in Table 6 below in terms of improvement of retention (transmittance increase) vs. the use of polymer alone. The ability to see improvements by adding the anionic naphthalene sulfonate condensate enhancer either prior to or after the cationic flocculant is important since, depending on paper machine conditions, it is often advantageous to add this enhancer prior to the flocculant.

TABLE 6

| Addition Method | Anionic lbs/ton | Transmittance/3 % | Improvement over Cationic Polymer % |
|---|---|---|---|
| Anionic after | 0.0 | 30.0 | 0.0 |
| Cationic | 1.0 | 46.0 | 53.0 |
| Polymer | 2.0 | 45.0 | 50.0 |
| Compound A | | | |
| Anionic after | 0.0 | 30.0 | 0.0 |
| Cationic | 0.5 | 43.0 | 43.0 |
| Polymer | 1.0 | 49.0 | 63.0 |
| Compound D | 2.0 | 49.5 | 65.0 |
| Anionic after | 0.0 | 39.0 | 0.0 |
| Cationic | 0.25 | 56.00 | 43.5 |
| Polymer | 0.50 | 56.50 | 45.5 |
| Compound D | 1.00 | 56.00 | 43.5 |

Changes can be made in the composition, operation and arrangement of the method of the present invention described herein without departing from the concept and scope of the invention as defined in the following claims:

I claim:

1. A papermaking process consisting of:

forming an aqueous cellulosic papermaking slurry;

adding a cationic polymer having a molecular weight of from 500,000 to 20,000,000 selected from the group consisting of dimethylaminoethyl acrylate methyl chloride quat, dimethylaminoethylmethacrylate, dimethylaminoethyl acrylate benzyl chloride quat, dimethylaminoethylmethacrylate methyl chloride quat, [3-methacryloylamino-propyl]trimethyl ammonium chloride, N-[3-(Dimethylamino)propyl]-methacrylamide and acrylamide copolymers thereof, in an amount of at least 0.01 weight percent based on dry weight of slurry solids;

adding an anionic polymer to the slurry, the anionic salt comprising a formaldehyde condensate of a naphthalene sulfonic acid salt, in an amount of from about 0.005 weight percent to about 0.5 weight percent based on dry weight of slurry solids;

draining the slurry to form a sheet, and drying the sheet.

2. The process of claim 1 wherein the low molecular weight anionic polymer is added to the slurry by feeding to the slurry an aqueous solution containing the anionic polymer.

3. The process of claim 1 wherein the cationic polymer has a charge density of at least about 0.15 equivalents of cationic nitrogen per kilogram of the cationic polymer.

4. The process of claim 3 wherein the cationic polymer has a charge density of at least 0.6 equivalents of cationic nitrogen per kilogram of the high molecular weight cationic polymer.

5. The process of claim 1 wherein the slurry is drained on a papermaking screen and is pumped to the site of the papermaking screen prior to draining, and further wherein the low molecular weight anionic polymer is added to the slurry subsequent to the pumping and prior to the draining.

6. The process of claim 1 wherein the slurry has a pH of from about 3.0 to about 9.0.

7. The process of claim 1 wherein the low molecular weight anionic polymer is added to the slurry in the amount of from about 0.01 to about 0.2 weight percent based on dry weight of slurry solids.

8. The process of claim 1 wherein the low molecular weight anionic polymer has a weight average molecular weight of from about 500 to about 120,000.

9. The process of claim 1 wherein the salt is an alkaline earth, alkali metal or ammonia.

10. The process of claim 1 wherein the anionic polymer is added prior to addition of the cationic flocculant.

11. The process of claim 1 wherein inorganic or organic cationic coagulants are added to the furnish prior to addition of the anionic polymer.

* * * * *